US005812093A

United States Patent [19]

Thompson et al.

[11] Patent Number: 5,812,093

[45] Date of Patent: Sep. 22, 1998

[54] ANTENNA ASSEMBLY FOR A WIRELESS-COMMUNICATION DEVICE

[75] Inventors: David C. Thompson, Grayslake; Jin D. Kim; Jon J. Powles, both of Mundelein, all of Ill.

[73] Assignee: Motorola, Inc., Schaumburg, Ill.

[21] Appl. No.: 536,404

[22] Filed: Sep. 29, 1995

[51] Int. Cl.[6] ..... H01Q 1/24

[52] U.S. Cl. ..... 343/702; 343/895; 343/901

[58] Field of Search ..... 343/702, 895, 343/900, 901, 906; H01Q 1/24

[56] References Cited

U.S. PATENT DOCUMENTS

| | | | |
|---|---|---|---|
| 4,860,024 | 8/1989 | Egashira | 343/702 |
| 5,177,492 | 1/1993 | Tomura et al. | 343/702 |
| 5,204,687 | 4/1993 | Elliott et al. | 343/702 |
| 5,212,491 | 5/1993 | Chin et al. | 343/745 |
| 5,317,325 | 5/1994 | Bottomley | 343/702 |
| 5,353,036 | 10/1994 | Baldry | 343/702 |
| 5,374,937 | 12/1994 | Tsunekawa et al. | 343/702 |
| 5,438,339 | 8/1995 | Itoh et al. | 343/702 |
| 5,467,096 | 11/1995 | Takamoro et al. | 343/702 |
| 5,583,519 | 12/1996 | Koike | 343/702 |
| 5,661,496 | 8/1997 | Baek et al. | 343/895 |

FOREIGN PATENT DOCUMENTS

| | | |
|---|---|---|
| 2036677 | 8/1991 | Canada . |
| 0 467 822 A2 | 1/1992 | European Pat. Off. . |
| 0 508 836 A1 | 10/1992 | European Pat. Off. . |
| 0 613 207 A1 | 8/1994 | European Pat. Off. . |
| 64-60101 | 3/1989 | Japan . |
| 1-160101 | 6/1989 | Japan . |
| 3-186001 | 8/1991 | Japan . |
| 2 253 949 A | 9/1992 | United Kingdom . |
| WO92/16980 | 10/1992 | WIPO . |

*Primary Examiner*—Hoanganh T. Le

*Attorney, Agent, or Firm*—Donald C. Kordich; Lalita P. Williams

[57] ABSTRACT

A retractable antenna assembly provides a substantially matched antenna impedance to a matching circuit (712) of a radiotelephone (200) whether the retractable antenna assembly is in the extended position or the retracted position. In one embodiment parts (304, 312) of a capacitor (714) are integrally formed on an upper portion of the retractable antenna assembly (206) such that when in the retracted position the capacitor (714) contributes to the overall antenna impedance. In another embodiment a capacitor (1302) is integrally formed on the lower portion of the retractable antenna assembly (900).

20 Claims, 11 Drawing Sheets

114
102
106
112
100
104
101
108
CIRCUITRY

ANTENNA ASSEMBLY FOR A WIRELESS-COMMUNICATION DEVICE

FIELD OF THE INVENTION

The present invention relates generally to the field of wireless communication, and more particularly to an antenna assembly for a wireless-communication device. Although the invention is subject to a wide range of applications, it is especially suited for use in wireless-communication devices, such as hand-held radiotelephones, and will be particularly described in that connection.

BACKGROUND OF THE INVENTION

Typically, wireless-communication devices, e.g., cordless telephones, cellular telephones, or personal digital assistants, include electronics, a housing containing the electronics, and some form of an antenna assembly for radiating and receiving radio-frequency (RF) signals that is physically mounted to the housing and electrically coupled with the electronics. For a personal, hand-held, wireless-communication device, a desirable antenna assembly has a physical size commensurate with the housing and typically moveable between a retracted position and an extended position relative the housing. When the device is to be tucked in a shirt pocket, purse, or brief case, e.g., the antenna is usually retracted to reduce the device's overall size. As wireless-communication devices increasingly become smaller and lighter in response to consumer demand, the antenna assembly for these smaller devices must correspondingly conform to the smaller dimensions of the housing.

An example of a conventional antenna assembly for a hand-held wireless-communication device is the one used in the MicroTAC Elite® brand cellular radiotelephones available from Motorola, Inc. FIG. 1 illustrates the conventional antenna arrangement in the extended position for this radiotelephone. Radiotelephone 100 includes a housing 101, an antenna arrangement 102, and a circuitry 108. Antenna arrangement 102 is mounted to housing 101 and is electrically coupled to circuitry 108.

Antenna arrangement 102 includes a helicoil 104 and a radiating element 106. Radiating element 106 is movable relative to housing 101 and helicoil 104 between the extended position and the retracted position.

Helicoil 104 is physically spaced apart from radiating element 106, and thus is not in direct physical contact with radiating element 106. They are, however, electrically coupled in both the extended position and the retracted position through a combination of capacitive and inductive coupling. Through this coupling, regardless of whether the antenna arrangement is in the extended position or the antenna arrangement is in the retracted position, a similar impedance of the antenna arrangement is coupled to circuitry 108. This feature reduces the complexity of circuitry 108 by eliminating the need for more than one impedance matching circuit, which would be required whenever the impedance of the antenna arrangement is sufficiently dissimilar between the extended position and the retracted position.

Although suitable for some wireless-communication devices, such a conventional antenna arrangement is not suitable for all wireless-communication devices. As wireless-communication devices become smaller, the human hand holding the wireless-communication device envelops more of the device, including the housing area near where the antenna arrangement egresses the housing. As such, the human hand can interfere with the contactless electrical coupling of the previously described antenna arrangement, resulting in degraded antenna performance.

Another conventional antenna arrangement for a radiotelephone is described in U.S. Pat. No. 5,177,492, issued Jan. 5, 1993, to Masahi Tomura et al., and assigned to Fujitsu Limited. This patent describes a rod antenna mounting mechanism wherein a single feeder plate, coupled with circuitry in the radiotelephone, is in direct physical contact with the rod antenna assembly. This patent, however, neither address the mismatch of the impedance of the antenna assembly in the retracted position and the extended position, nor the matching circuitry required to adjust to the impedance mismatch.

Other conventional antenna arrangements for radios are described in Japanese Kokai Patent (A) No. HEI 1-60101 published Jun. 23, 1989, issued to J. Takada and applied for by Matsushita Denki Sangyo K. K. One antenna arrangement is a rod-shaped antenna that is electrically coupled with a circuit board in the radio via a first connecting terminal, whether the antenna element is in the extended position or in the retracted position. In the extended position, the first connecting terminal is in direct contact with the lower portion of the rod-shaped antenna; in the retracted position, the first connecting terminal is in direct contact with the upper portion of the rod-shaped antenna. Because of the direct contact, this antenna arrangement may not have the interference problems that could arise by contactless coupling to the antenna element.

This first-described antenna arrangement, however, has a problem when the antenna element is in the retracted position, i.e., the antenna element is affected by the case of the radio and the circuit board, thus causing loss of antenna gain.

To offset this problem, a second antenna arrangement is described that additionally provides a matching circuit that is in electrical contact with the lower portion of the rod-shaped antenna when the antenna arrangement is in the retracted position. The matching circuit allegedly reduces the mismatch created by the effect of the case and circuit board on the antenna.

Although suitable for some wireless-communication devices, this second antenna arrangement is not suitable for all wireless-communication devices. For example, the added matching circuit consumes circuit board space. This can be a problem for increasingly smaller wireless-communication devices that have correspondingly smaller circuit boards and limited space for placing additional components thereon. Also, the additional matching circuit is composed of piece parts that must be handled and installed on the circuit board, which increases the cost of manufacturing. Moreover, the circuit board itself can affect the matching circuit when it is mounted thereon as a result of stray capacitance, and thus degrade antenna performance.

A need therefore exists for a retractable antenna assembly for a wireless-communication device that reduces interference caused by the human hand and the circuit board, and does not require an additional matching circuit on the circuit board to improve antenna performance in the retracted position.

DETAILED DESCRIPTION OF THE PREFERRED EMBODIMENTS

Retractable antenna assemblies for a wireless-communication device described herein provide advantages over known antenna arrangements in that they reduce interference caused by the circuit board and the human hand in close proximity to the antenna assembly, and provide a substantially matched antenna impedance whether the antenna assembly is in the extended position or the retracted position, thus not requiring an additional matching circuit on the circuit board. These advantages over the conventional antenna arrangements are principally provided by a capacitor, or components of a capacitor, integrally formed on the antenna assembly. This capacitor supplies substantial additional reactance to the antenna assembly's impedance when in the retracted position. The value of this additional reactance is a preselected value so that the impedance of the antenna assembly in the retracted position substantially matches the impedance of the antenna assembly in the extended position.

In one such embodiment configured according to the present invention, a capacitor is formed by the combination of a linear radiating element, a coating of dielectric material covering the linear radiating element, and a feed-point contact making direct physical with the coating at the upper portion of the linear radiating element. In a second embodiment configured according to the present invention, a capacitor is integrally formed by a linear radiating element, a dielectric coating covering the linear radiating element, and a conductive ferrule at least partially encircling the dielectric coating at the bottom portion of the linear radiating element.

Reference will now be made in detail to the first embodiment configured according to the present invention.

Figure 1:
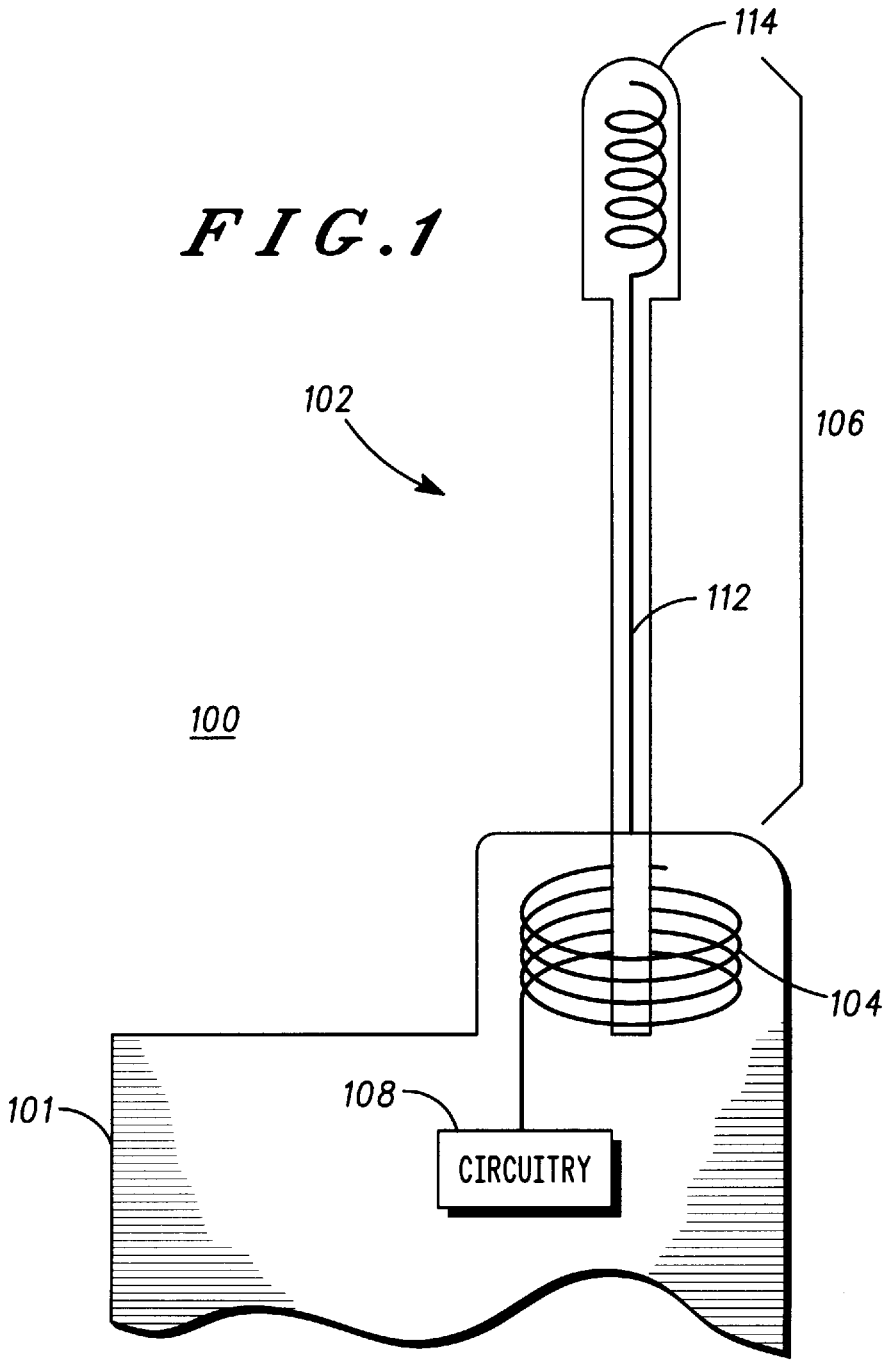
FIG. 1 illustrates a generalized front-elevation view of a radiotelephone employing a conventional antenna arrangement in an extended position.
Figure 2:
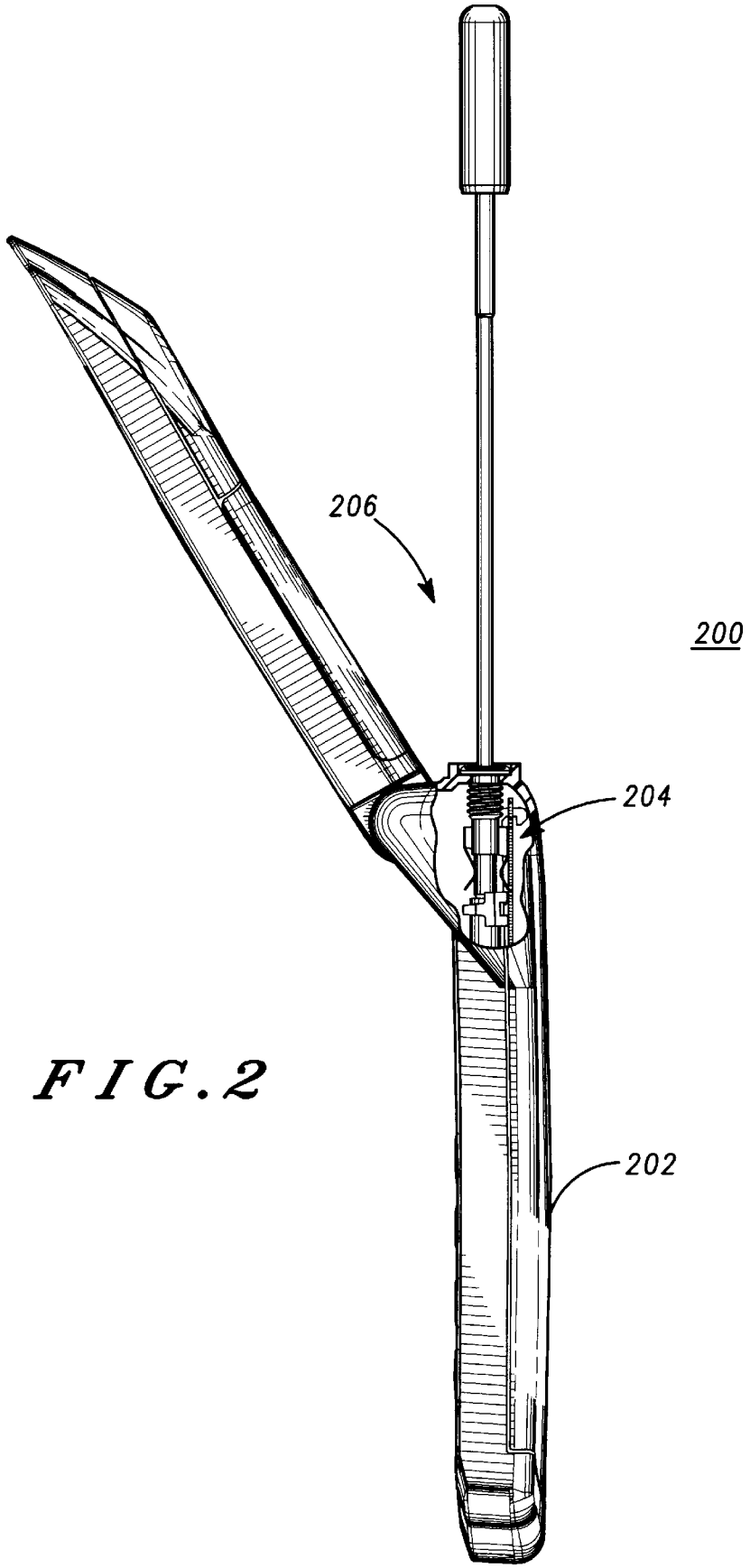
FIG. 2 illustrates a generalized right-side-elevation view of a radiotelephone employing a first embodiment of an antenna assembly in an extended position, configured according to the present invention, with a partial section showing the location of the antenna assembly relative to the radiotelephone.

A radiotelephone employing a first embodiment of antenna assembly in an extended position is shown in FIG. 2. Radiotelephone 200 includes a housing 202, a retractable antenna assembly 206 and, as shown in the partial section, a circuit board 204.

Figure 3:
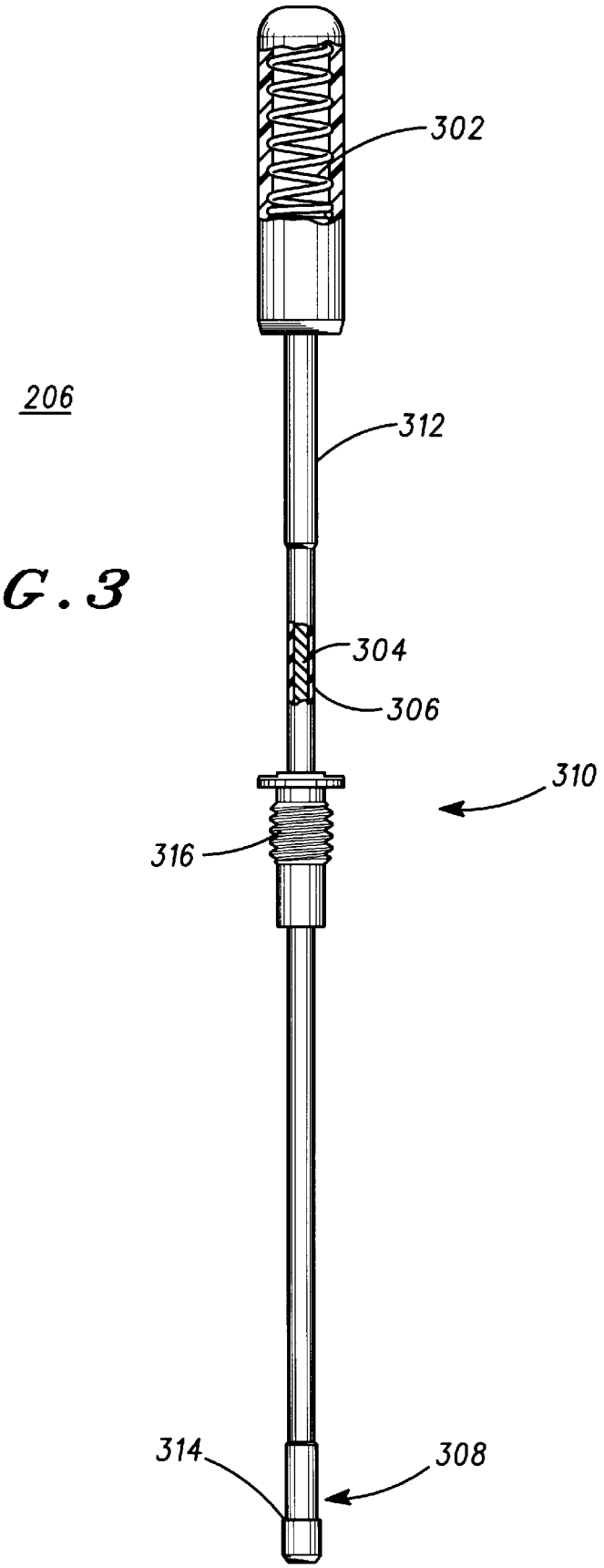
FIG. 3 illustrates an elevation view of the antenna assembly shown in FIG. 2, with partial sections showing a linear radiating element and a helical radiating element.

As embodied herein and referring to FIG. 3, first antenna assembly 206 includes a helical radiating element 302, a linear radiating element 304, a coating 306, a ferrule 308, and a bushing 310.

Helical radiating element 302, shown in the partial section, can be, e.g., a compact, spiral-wound length of metal wire composed of, e.g., steel with copper plating.

Linear radiating element 304, shown in the partial section, can be, e.g., a long, straight- or tightly-wound length of metal wire composed of, e.g., nickel titanium. Linear radiating element 304 has a lower portion and an upper portion, and the upper portion is in direct physical and electrical contact with an end of helical radiating element 302.

Coating 306 is composed of, for example, a dielectric material such as polyurethane, and covers at least the upper portion and the lower portion of linear radiating element 304. Coating 306 is built up at the upper portion of linear radiating element 304, forming a coating portion 312 with a thickness greater than the thickness of the thin coating on the remainder of linear radiating element 304. Coating 306 also covers helical radiating element 302 and is built up to encapsulate helical radiating element 302 with a substantially cylindrical mass of dielectric material.

Ferrule 308 can be composed of a thin sheet of conductive material, e.g., nickel alloy, gold alloy, or copper alloy, that at least partially encircles the coating or covered lower portion of linear radiating element 304. Ferrule 308 is in direct electrical contact with linear radiating element 304 at the lower portion. A lip 314 is formed in ferrule 308, e.g., at approximately the middle of ferrule 308, by the difference in diameter between the bottom portion and the top portion of ferrule 308.

Bushing 310 can be a substantially cylindrical-shaped form of any suitable material, e.g., metal or preferably plastic, with a threaded portion 316 on its exterior surface. Threaded portion 316 can be used to mount bushing 310 to housing 202. Further, bushing 310 has an inner diameter large enough to allow linear radiating element 304 with its coating 306 to make slideable contact with the inner cylindrical surface of bushing 310. Accordingly, when bushing 310 is mounted to housing 202, linear radiating element 304 is thus moveable relative to housing 202 to an extended position and a retracted position.

Figure 4:
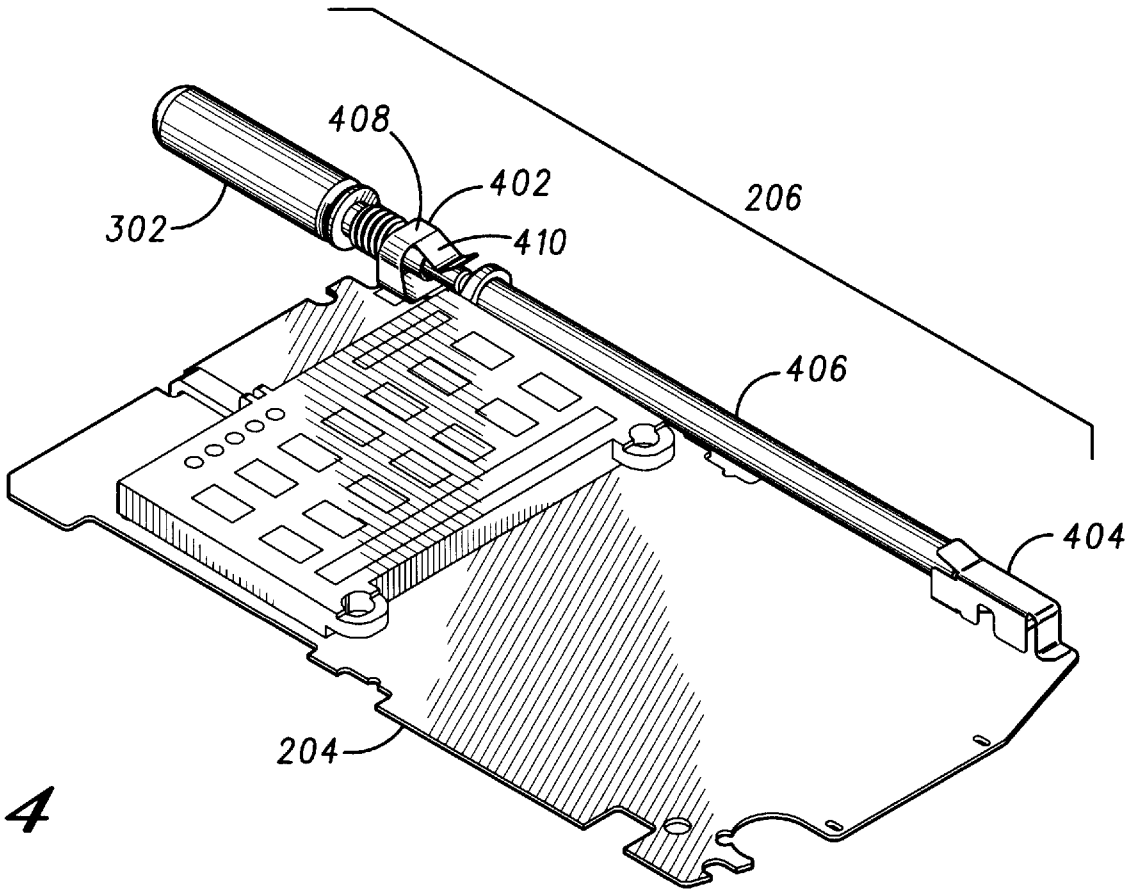
FIG. 4 illustrates an isometric view of the first embodiment of the antenna assembly in the retracted position, situated relative to a circuit board housed in the radiotelephone shown in FIG. 2.

FIG. 4 illustrates an isometric view of first antenna assembly 206 and circuit board 204 with first antenna assembly 206 in the retracted position. This figure clearly illustrates the circuit-board components that first antenna assembly 206 interfaces with. Circuit board 204 includes a feed-point contact 402, a termination contact 404, and a straw 406.

Circuit board 204 can be a circuit board of the wireless-communication device, e.g., a circuit board that further includes a ground or ground plane and the radio-frequency circuits used in wireless communication, such as, a matching circuit for matching the impedance of the antenna to the impedance of the circuit board.

Feed-point contact 402 conducts electrical signals to and from first antenna assembly 206 and circuit board 204. It can be a flexible electrical contact of any suitable shape and conductive material, e.g., nickel alloy, gold alloy, or copper alloy. In this exemplary embodiment, feed-point contact 402 has a collar 408 of a U-shape and a pair of shoulders 410 extending therefrom that have a crimp at approximately the middle of the length of a shoulder. Feed-point contact 402 can be mounted on circuit board 204 and shoulders 410 can make slideable contact with first antenna assembly 206 at preselected locations on first antenna assembly 206 when first antenna assembly 206 is in the extended position or in the retracted position.

Termination contact 404 can be in direct electrical contact with the ground or ground plane and provides a ground path from first antenna assembly 206 to circuit board 204. It can be a flexible electrical contact of any suitable shape and conductive material, e.g., nickel alloy, gold alloy, or copper alloy. Termination contact 404 can be mounted on circuit board 204, and makes direct physical contact with first antenna assembly 206 at a preselected location on first antenna assembly 206 when first antenna assembly 206 is in the retracted position.

Straw 406 is a long, at least semi-rigid, substantially cylindrical-shaped tube of any suitable material, e.g., plastic, plastic with a conductive coating, or metal. It can be in direct physical contact with, and fixedly held in position over the circuit board by any suitable means. Straw 406 guides linear radiating element 304 into housing 202 when first antenna assembly 206 is placed in the retracted position from the extended position, thus ensuring that ferrule 308 is in direct physical contact with termination contact 404 when first antenna assembly 206 is in the retracted position.

Figure 5:
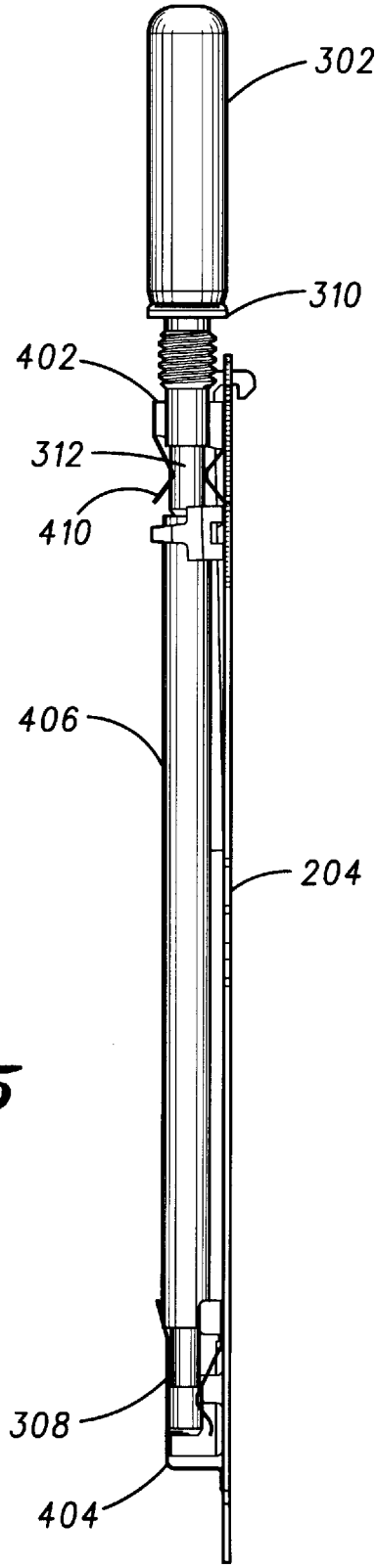
FIG. 5 illustrates a right-side-elevation view of the first embodiment of the antenna assembly in the retracted position, situated relative to the circuit board housed in the radiotelephone shown in FIG. 2.

FIG. 5 illustrates a side-elevation view of first antenna assembly 206 and circuit board 204 when first antenna assembly 206 is in the retracted position. In this position, helical radiating element 302 protrudes from housing 202, and linear radiating element 304 is contained in housing 202. This figure clearly illustrates the physical arrangement of the contacts and antenna assembly in the retracted position. That is, helical radiating element 302 abuts bushing 310 and limits the retraction position of first antenna assembly 206. At this resting position, coating portion 312 is partially inserted into bushing 310, with a portion of the coating extending a distance below bushing 310. Further, shoulders 410 are in slideable and direct physical contact with coating 306 near the upper portion of linear radiating element 304. In this exemplary embodiment, shoulders 410 make direct physical and electrical contact with coating portion 312 extending below bushing 310, but shoulders 410 could make contact with the thin portion of coating 306. Moreover, a substantial portion of linear radiating element 304 is housed inside straw 406, with ferrule 308 partially or fully extending beyond straw 406. In this fully retracted position, ferrule 308 is in slideable contact with termination contact 404.

Figure 6:
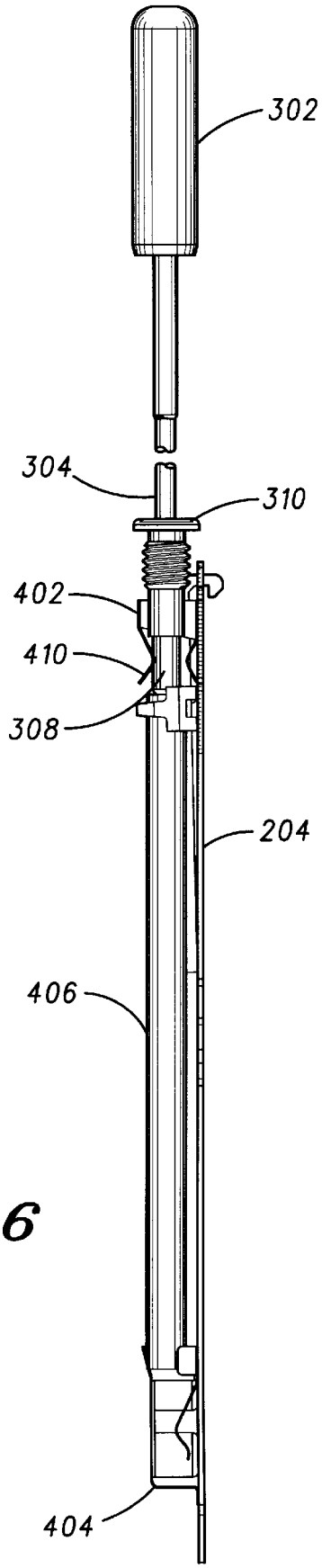
FIG. 6 illustrates a right-side-elevation view of the first embodiment of the antenna assembly in the extended position, situated relative to the circuit board housed in the radiotelephone shown in FIG. 2.

FIG. 6 illustrates a side-elevation view of first antenna assembly 206 and circuit board 204 with first antenna assembly 206 in the extended position. Both helical radiating element 302 and linear radiating element 304 protrude from housing 202. This figure illustrates the physical arrangement of the contacts and antenna assembly in the extended position. That is, lip 314 abuts bushing 310, which limits the extension position of first antenna assembly 206. In this resting position, substantially all of linear radiating element 304 extends above bushing 310. However, a small portion of the lower portion of linear radiating element 304 and the upper portion of ferrule 308 are encircled by bushing 310. The upper portion of ferrule 308 is in slideable contact with bushing 310. Finally, shoulders 410 are in slideable contact with the lower portion of ferrule 308 extending below bushing 310.

Figure 7:
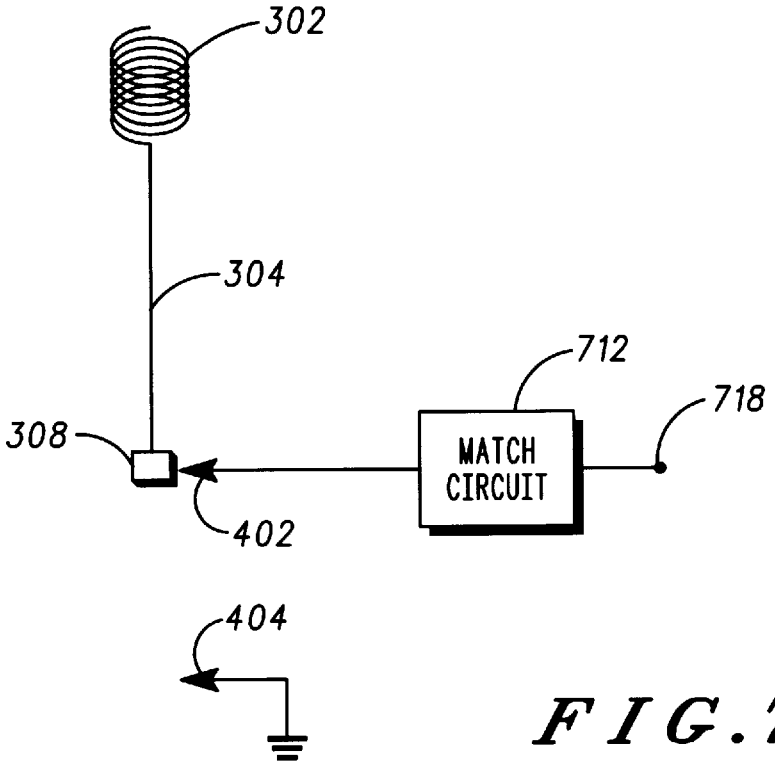
FIG. 7 illustrates a generalized electrical schematic showing the coupling between the first embodiment of the antenna assembly and the circuit board housed in the radiotelephone shown in FIG. 2, when the first embodiment of the antenna assembly is in the extended position.
Figure 8:
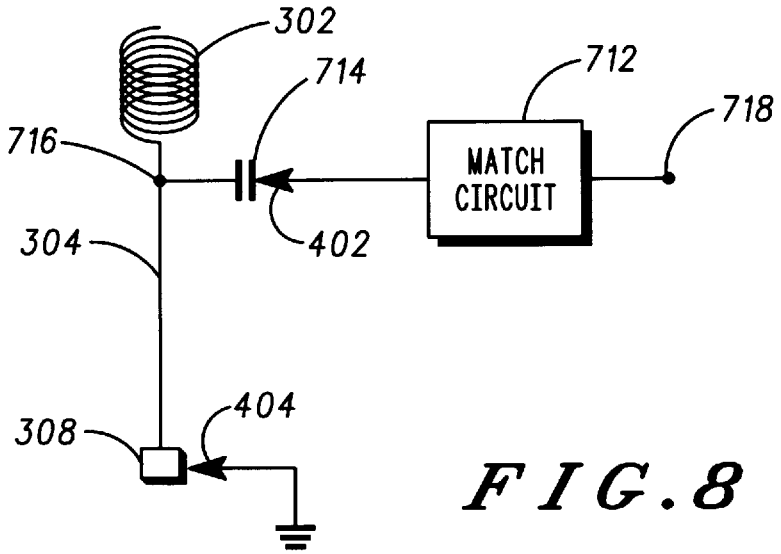
FIG. 8 illustrates a generalized electrical schematic showing the coupling between the first embodiment of the antenna assembly and the circuit board housed in the radiotelephone shown in FIG. 2, when the first embodiment of the antenna assembly is in the retracted position.

FIGS. 7 and 8 illustrate partial electrical schematics showing the coupling between the first embodiment of the antenna assembly and the circuit board housed in the radiotelephone shown in FIG. 2, when the first embodiment of the antenna assembly is in the extended position and the retracted position, respectively.

As shown in FIG. 7, in the extended position, feed-point contact 402 makes direct electrical contact with ferrule 308, thus the lower portion of linear radiating element 304 is electrically coupled with feed-point contact 402. As viewed from feed-point contact 402, the antenna assembly is comprised of linear radiating element 304, which can have, e.g., an electrical length of approximately a quarter wavelength, and helical radiating element 302, which can have, e.g., an electrical length of approximately a quarter wavelength. In this extended position, first antenna assembly 206 functions as approximately a half-wavelength antenna that can have an impedance as viewed from feed-point contact 402 ($Z_e$) generally in the range of approximately 300 to 500 ohms. $Z_e$ typically does not match the impedance of the circuitry of circuit board 204 ($Z_o$), which can have an impedance generally in the range of approximately 30 to 100 ohms. Consequently, a matching circuit 712 is required between feed-point contact 402 and the remainder of the circuitry of circuit board 204 to substantially match $Z_e$ to $Z_o$.

Turning now to the partial electrical schematic for the retracted position shown in FIG. 8, ferrule 308 is in direct electrical contact with termination contact 404, which can be coupled to a ground or reference voltage located on circuit board 204. This couples the lower portion of linear radiating element 304 to ground. As a result, and further due in part to the close proximity of linear radiating element 304 to the ground plane of circuit board 204, in this retracted position ground-coupled linear radiating element 304 adopts the characteristics of a radio-frequency transmission line. If linear radiating element 304 has an electrical length of approximately a quarter wavelength, those skilled in the art will recognize that at point 716, the impedance of ground-coupled linear radiating element 304 ($Z_t$) appears as approximately an open circuit with a very large impedance value.

At the upper portion of linear radiating element 304, the physical arrangement of linear radiating element 304 and coating portion 312 are parts of a capacitor integrally formed on linear radiating element 304. These parts of a capacitor along with feed-point contact 402, which is in direct electrical contact with coating portion 312 when retractable antenna assembly 206 is in the retracted position, form the capacitor, creating capacitive coupling between upper portion of linear radiating element 304 and feed-point contact 402. This capacitive coupling is represented by a capacitor 714, having an impedance $Z_c$. This is an important feature of the present invention because this capacitor 714 provides an additional series impedance to the antenna assembly in the retracted position, as viewed from matching circuit 712, that is not present when the antenna assembly is in the extended position.

To illustrate the importance of capacitor 714 in the retracted position, the open-circuit $Z_t$ in parallel with the impedance of helical radiating element 302 ($Z_h$) is essentially $Z_h$. Thus, the impedance of the antenna assembly in the retracted position ($Z_r$) is essentially the impedance of the series-connected $Z_h$ and $Z_c$. Accordingly, when capacitor 714 is chosen to be a preselected value such that the sum of $Z_h$ and $Z_c$ is substantially matched to $Z_e$, then a single matching circuit can be used to substantially match $Z_r$ and $Z_e$ to $Z_o$ at point 718.

The technique for obtaining the capacitance necessary for capacitor 714 in this application is a well known technique in the art and depends upon many interplaying factors, e.g., the signal's frequency range, the structure of the radiating elements, the thickness and dielectric constant of the coating, and the configuration of the feed-point contact and its point of contact on the antenna assembly.

So configured, the first embodiment provides numerous advantages over conventional antenna arrangements. For example, the direct physical contact of feed-point contact 402 to the antenna assembly reduces interference caused by circuit board 204 or the human hand holding the wireless-communication device. Also, the impedance of the antenna assembly, whether in the extended position or retracted position, can be substantially matched to the impedance of circuit board 204 by a single matching circuit 712.

Those skilled in the art will recognize that various modifications and variations can be made to the above-described embodiment without departing from the scope or spirit of this invention. For example, instead of relying on the ground plane of circuit board 204 to assist in providing the transmission-line characteristics of linear radiating element 304, straw 406 can at least partially be composed of conductive material and in direct electrical contact with the ground to form a coaxial line with linear radiating element 304 inserted therein. Also, instead of feed-point contact 402 making direct physical contact with the coating covering the upper portion of linear radiating element 304 when in the retracted position, another ferrule composed of a thin sheet of conductive material at least partially encircling the coating covering the upper portion may be added, thus creating a capacitor on the upper portion. Feed-point contact 402 can make direct electrical contact with the another ferrule in the retracted position, creating capacitive coupling between the upper portion and the feed-point contact.

Figure 9:
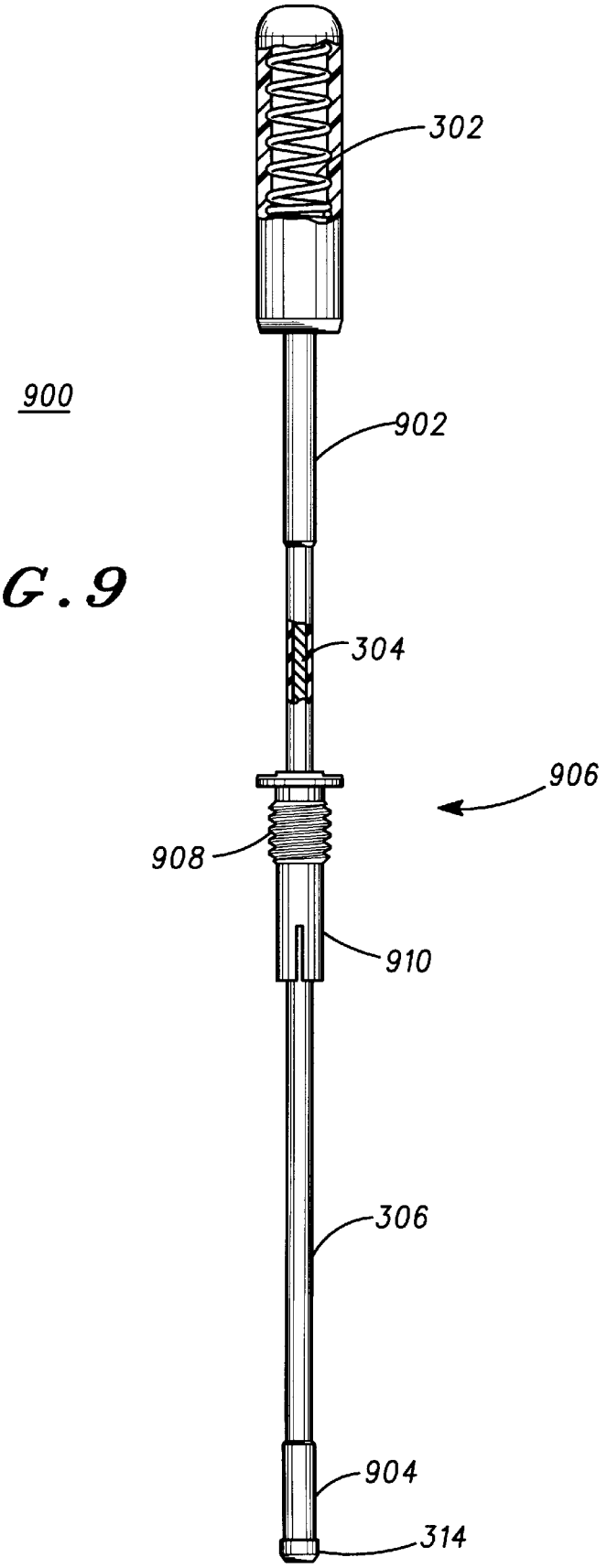
FIG. 9 illustrates an elevation view of a second embodiment of an antenna assembly, configured according to the present invention, with partial sections showing a linear radiating element and a helical radiating element.

Other embodiments of the invention are possible. For example, a second embodiment configured according to the present invention is shown in FIG. 9. Where appropriate the same reference numerals are used to avoid unnecessary duplication and description of similar elements already referred to and described above. Only the significant differences of the second embodiment as compared to the first embodiment will be discussed hereafter.

A retractable antenna assembly 900 includes a lower ferrule 904, an upper ferrule 902, and a bushing 906.

Instead of coating portion 312 at the upper portion of linear radiating element 304, coating 306 is substantially uniform over linear radiating element 304. Upper ferrule 902 can be a thin sheet of conductive material, e.g., nickel alloy, gold alloy, or copper alloy, that at least partially encircles the coating or covered upper portion of linear radiating element 304, and is in direct electrical connection with linear radiating element 304.

Also, instead of ferrule 308 being in direct electrical contact with linear radiating element 304 at its lower portion, a lower ferrule 904, which can be a thin sheet of conductive material, e.g., nickel alloy, gold alloy, or copper alloy, at least partially encircles the coating or covered lower portion of linear radiating element 304 but is not in direct electrical connection with linear radiating element 304. Consequently, the lower portion of linear radiating element 304 and coating 306 covering the lower portion are parts of a capacitor integrally formed on linear radiating element 304, and along with lower ferrule 904 form a capacitor.

Furthermore, bushing 906 includes not only a threaded portion 908, but also an extended portion 910 that is cylindrical in form and is composed of a conductive material.

Figure 10:
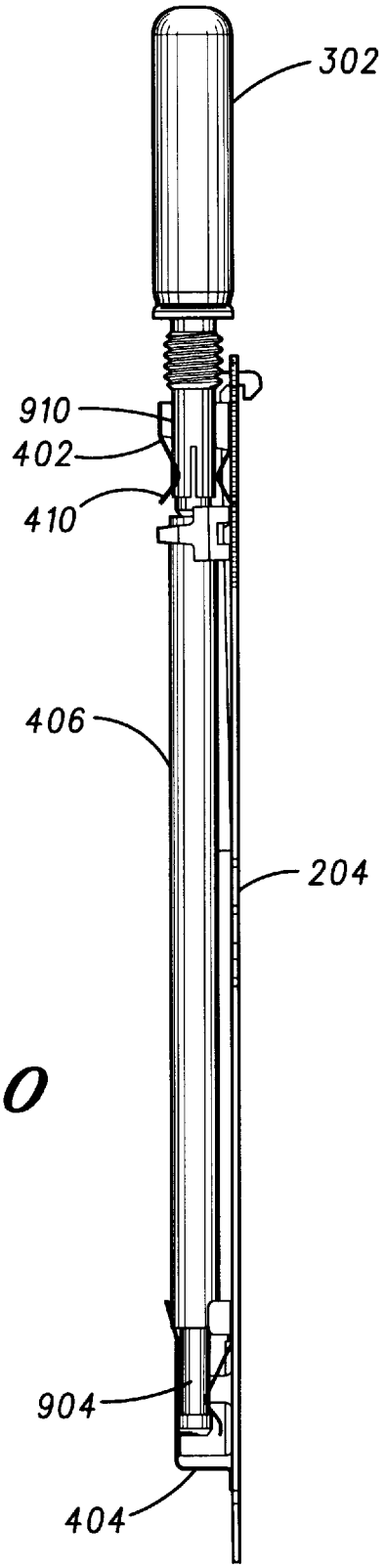
FIG. 10 illustrates a right-side-elevation view of the second embodiment of the antenna assembly in the retracted position, situated relative to a circuit board housed in the radiotelephone shown in FIG. 2.

FIG. 10 illustrates a side-elevation view of second antenna assembly 900 and circuit board 204 when second antenna assembly 900 is in the retracted position. In this position, termination contact 404 is in slideable contact with lower ferrule 904; upper ferrule 902 is at least partially disposed in, and in slideable contact with, extended portion 910; and feed-point contact 402 is in contact with extended portion 910. Feed-point contact 402 and extended portion 910 remain in stationary contact whether second antenna assembly 900 is in the extended position or retracted position.

Figure 11:
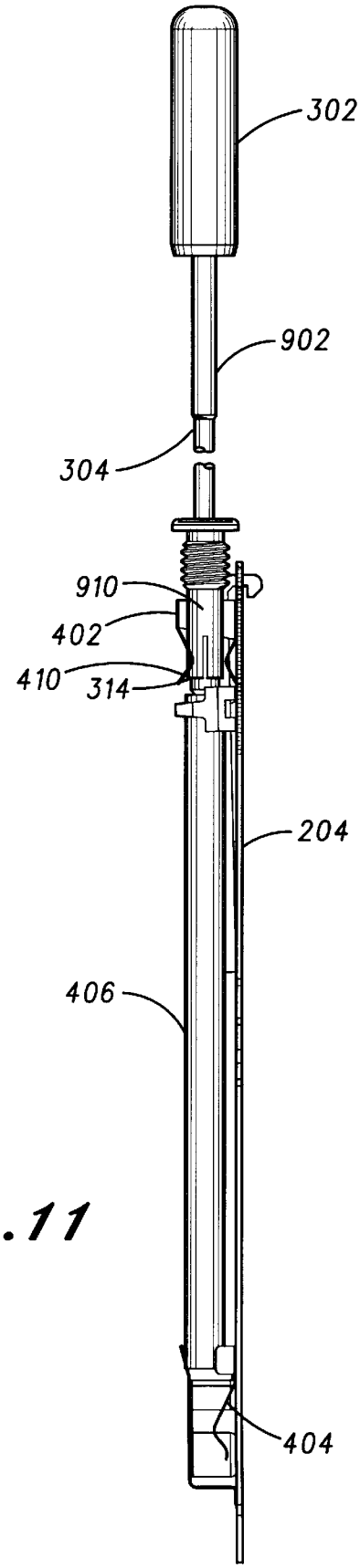
FIG. 11 illustrates a right-side-elevation view of the second embodiment of the antenna assembly in the extended position, situated relative to a circuit board housed in the radiotelephone shown in FIG. 2.

FIG. 11 illustrates a side-elevation view of second antenna assembly 900 and circuit board 204 with second antenna assembly 900 in the extended position. Lower ferrule 904 is at least partially disposed in, and in slideable contact with, extended portion 910.

Figure 12:
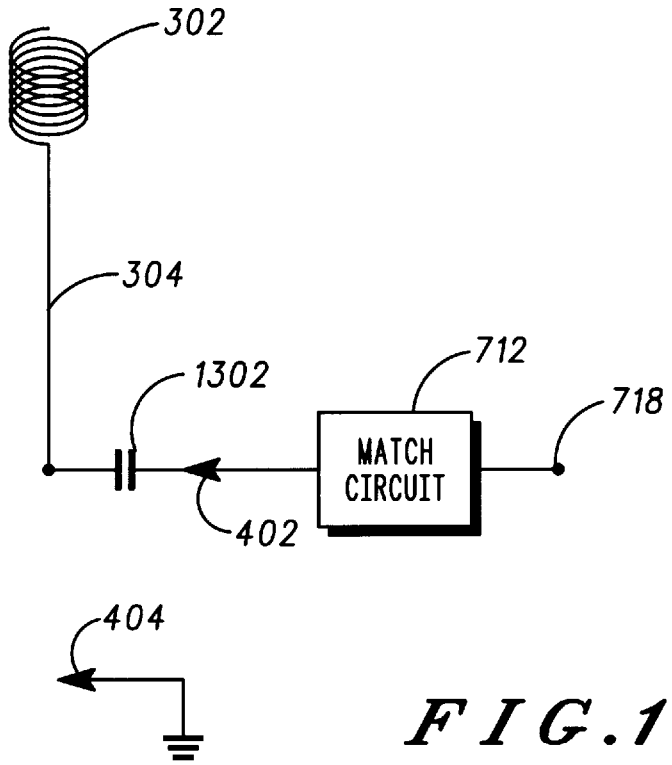
FIG. 12 illustrates a generalized electrical schematic showing the coupling between the second embodiment of the antenna assembly and the circuit board housed in the radiotelephone shown in FIG. 2, when the first embodiment of the antenna assembly is in the extended position.
Figure 13:
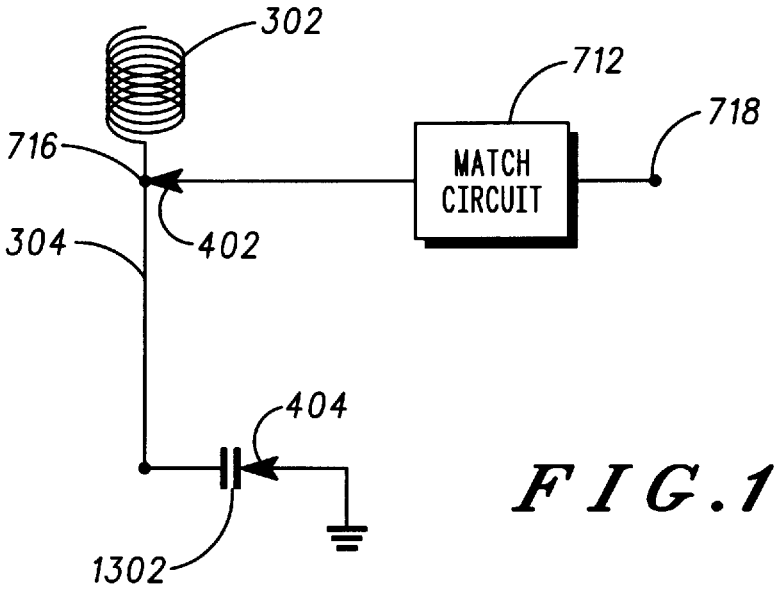
FIG. 13 illustrates a generalized electrical schematic showing the coupling between the second embodiment of the antenna assembly and the circuit board housed in the radiotelephone shown in FIG. 2, when the first embodiment of the antenna assembly is in the retracted position.

FIGS. 12 and 13 illustrate partial electrical schematics showing the coupling between the second embodiment of the antenna assembly and the circuit board housed in the radiotelephone shown in FIG. 2, when the second embodiment of the antenna assembly is in the extended position and the retracted position, respectively.

As shown in FIG. 12, in the extended position, the capacitive element formed by lower ferrule 904 (and to some degree extended portion 910), coating 306, and linear radiating element 304 is represented by a capacitor 1302. Thus, feed-point contact 402, when in direct electrical contact with lower ferrule 904 via extended portion 910 in the extended position, is capacitively coupled to the lower portion of linear radiating element 304.

Turning now to the partial electrical schematic of the retracted position shown in FIG. 13, feed-point contact 402 is electrically coupled, i.e., in direct electrical contact, with the upper portion of linear radiating element 304 via extended portion 910 and upper ferrule 902. Further, termination contact 404 is in direct electrical contact with lower ferrule 904, creating capacitive coupling between termination contact 404 and the lower portion of linear radiating element 304.

The technique for obtaining the capacitance necessary for capacitor 1302 in this application is a well known technique in the art. To illustrate the importance of capacitor 1302, when linear radiating element 304 has an electrical length of approximately a quarter wavelength and adopts transmission line or coaxial line characteristics in the retracted position, the impedance of ground-terminated capacitor 1302 is transformed into an inductance ($Z_t$) at point 716. On the other hand, when helical radiating element 302 is shorter than an approximately quarter-wavelength helicoil, its impedance ($Z_h$) at RF-signal frequencies can be capacitive. A capacitive $Z_h$ in parallel with an inductive $Z_t$ can create an impedance at feed-point contact 402 ($Z_r$) that is greater than $Z_h$ or $Z_t$ alone. Accordingly, capacitor 1302 can be chosen to be a preselected value such that $Z_r$ and $Z_e$ have substantially matched impedance values so that a single matching circuit can be used to substantially match $Z_r$ and $Z_e$ to $Z_o$ at point 718.

Those skilled in the art will recognize that various modifications and variations can be made to the above-described second embodiment without departing from the scope or spirit of this invention. For example, extended portion 910 can be shortened, and feed-point contact 402 can instead make direct physical contact with upper ferrule 902 and lower ferrule 904 in the retracted position and extended position, respectively.

What is claimed is:

1. A retractable antenna assembly for a wireless-communication device, the retractable antenna assembly having an extended position and a retracted position relative to the wireless-communication device and having an antenna impedance associated with each position, the wireless-communication device having a feed-point contact, the retractable antenna assembly comprising:

a helical radiating element;

a linear radiating element having an upper portion in direct electrical contact with the helical radiating element;

wherein when the antenna assembly is in the retracted position, a capacitor is formed between the linear radiating element and the feed point contact, the capacitor contributing to the antenna impedance at the feed-point contact in a manner that results in substantially the same antenna impedance at the feed-point contact when the antenna assembly is in the extended position.

2. The retractable antenna assembly of claim 1 further comprising a coating covering the upper portion, wherein in the retracted position the feed-point contact is in direct electrical contact with the coating, thus the capacitor is formed by the upper portion, the coating, and the feed-point contact, creating a capacitive coupling between the upper portion and the feed-point contact.

3. The retractable antenna assembly of claim 2, the linear radiating element further having a lower portion, wherein in the extended position the lower portion is electrically coupled with the feed-point contact.

4. The retractable antenna assembly of claim 1 further comprising a coating covering the upper portion and a ferrule at least partially encircling the coating, thus the capacitor is formed by the upper portion, the coating, and the ferrule.

5. The retractable antenna assembly of claim 4, wherein in the retracted position the ferrule is in direct electrical contact with the feed-point contact, creating capacitive coupling between the upper portion and the feed-point contact.

6. The retractable antenna assembly of claim 5, the linear radiating element further having a lower portion, wherein in the extended position the lower portion is electrically coupled with the feed-point contact.

7. The retractable antenna assembly of claim 1, the linear radiating element further having a lower portion, the retractable antenna assembly further comprising a coating covering the lower portion and a lower ferrule at least partially encircling the coating covering the lower portion, thus the capacitor is formed by the lower portion, the coating, and the lower ferrule.

8. The retractable antenna assembly of claim 7, the wireless-communication device further having a termination contact, wherein in the retracted position the lower ferrule is in direct electrical contact with the termination contact, creating a capacitive coupling between the lower portion and the termination contact.

9. The retractable antenna assembly of claim 8, wherein in the retracted position the upper portion is electrically coupled with the feed-point contact.

10. The retractable antenna assembly of claim 7, wherein in the extended position the lower ferrule is in direct electrical contact with the feed-point contact, thus capacitively coupling the lower portion with the feed-point contact.

11. The retractable antenna assembly of claim 1, the wireless-communication device further having a ground and a termination contact electrically coupled with the ground, the linear radiating element further having an electrical length of approximately a quarter wavelength and a lower portion electrically coupled with the termination contact in the retracted position, creating electrical coupling between the lower portion and the ground in the retracted position.

12. The retractable antenna assembly of claim 11, the wireless-communication device further having a ground plane, wherein in the retracted position the linear radiating element being in close proximity to the ground plane, thus the linear radiating element adopting transmission line characteristics in the retracted position.

13. The retractable antenna assembly of claim 1, the wireless-communication device further having a ground and a straw at least partially composed of conductive material and electrically coupled with the ground, wherein in the retracted position the linear radiating element is inserted within the straw, thus the linear radiating element and straw adopting coaxial line characteristics.

14. A wireless-communication device comprising:

a housing;

a circuit board contained in the housing and including a feed-point contact; and a retractable antenna assembly having an extended position and a retracted position relative to the housing and having an antenna impedance associated with each position, the retractable antenna assembly including, a helical radiating element, a linear radiating element having an upper portion in direct electrical contact with the helical radiating element;

wherein when the antenna assembly is in the retracted position, a capacitor is formed between the linear radiating element and the feed point contact, the capacitor contributing to the antenna impedance at the feed-point contact in a manner that results in substantially the same antenna impedance at the feed-point contact when the antenna assembly is in the extended position.

15. A retractable antenna assembly for a wireless-communication device, the retractable antenna assembly having an extended position and a retracted position relative to the wireless-communication device, the wireless-communication device having a feed-point contact and a termination contact, the retractable antenna assembly comprising:

a helical radiating element;

a linear radiating element having an upper portion and a lower portion, the upper portion in direct electrical contact with the helical radiating element;

a coating covering the upper portion and the lower portion; and a ferrule at least partially encircling the coating covering the lower portion and in direct electrical contact with the lower portion;

wherein in the retracted position the ferrule is in direct electrical contact with the termination contact, and the feed-point contact is in direct physical contact with the coating covering the upper portion, thus a capacitor is formed by the upper portion, the coating covering the upper portion, and the feed-point contact, creating a capacitive coupling between the upper portion and the feed-point contact.

16. The retractable antenna assembly of claim 15, wherein in the extended position the ferrule is in direct electrical contact with the feed-point contact, thus electrically coupling the lower portion and the feed-point contact.

17. The retractable antenna assembly of claim 16 further having an antenna impedance associated with each retracted position and extended position, wherein the capacitor is a preselected value such that the antenna impedance provided to the feed-point contact, whether the antenna assembly is in the extended position or in the retracted position, is substantially matched.

18. A retractable antenna assembly for a wireless-communication device, the retractable antenna assembly having an extended position and a retracted position relative to the wireless-communication device, the wireless-communication device having a feed-point contact and a termination contact, the retractable antenna assembly comprising:

a helical radiating element;

a linear radiating element having an upper portion and an lower portion, the upper portion being in direct electrical contact with the helical radiating element;

a coating covering the upper portion and the lower portion;

an upper ferrule at least partially encircling the coating covering the upper portion and in direct electrical contact with the linear radiating element; and a lower ferrule at least partially encircling the coating covering the lower portion, thus forming a capacitor by the lower portion, the coating covering the lower portion, and the lower ferrule;

wherein in the retracted position the upper portion is electrically coupled with the feed-point contact and the lower ferrule is in direct electrical contact with the termination contact, creating capacitive coupling between the lower portion and the termination contact.

19. The retractable antenna assembly of claim 18, wherein in the extended position the lower ferrule is in direct electrical contact with the feed-point contact, creating capacitive coupling between the lower portion and the feed-point contact.

20. The retractable antenna assembly of claim 19 further having an antenna impedance associated with each retracted position and extended position, wherein the capacitor is a preselected value such that the antenna impedance provided to the feed-point contact, whether the retractable antenna assembly is in the extended position or in the retracted position, is substantially matched.

* * * * *